US006036402A

United States Patent [19]

Meldrum et al.

[11] Patent Number: 6,036,402

[45] Date of Patent: Mar. 14, 2000

[54] COMPENSATING MEMBER FOR PAVERS

[75] Inventors: Peter John Meldrum; Stephen John Linnertson, both of Killingworth, Australia

[73] Assignee: Perma-Fit PTY Limited, Warabrook, Australia

[21] Appl. No.: 08/930,136

[22] PCT Filed: Apr. 12, 1997

[86] PCT No.: PCT/AU96/00215

§ 371 Date: Oct. 10, 1997

§ 102(e) Date: Oct. 10, 1997

[87] PCT Pub. No.: WO96/32539

PCT Pub. Date: Oct. 17, 1996

[30] Foreign Application Priority Data

Apr. 13, 1995 [AU] Australia ..... PN2404
May 22, 1995 [AU] Australia ..... PN3083

[51] Int. Cl.[7] ..... E01C 11/02

[52] U.S. Cl. ..... 404/47; 404/64; 404/67; 52/747.12

[58] Field of Search ..... 404/34, 37, 38, 404/40, 64, 48, 7, 73, 74, 6, 10, 50, 67, 47; 52/387, 747.11, 747.12; 47/33

[56] References Cited

U.S. PATENT DOCUMENTS

| | | | |
|---|---|---|---|
| 1,726,263 | 8/1929 | Gregg . | |
| 2,027,725 | 1/1936 | Fischer . | |
| 2,064,528 | 12/1936 | Fischer . | |
| 2,065,064 | 12/1936 | Fischer . | |
| 2,716,373 | 8/1955 | Scrivner et al. . | |
| 2,794,375 | 6/1957 | DiFalco et al. . | |
| 2,798,418 | 7/1957 | Dunnam . | |
| 3,179,026 | 4/1965 | Crone | 404/64 X |
| 4,329,080 | 5/1982 | Elley | 404/74 |
| 4,647,491 | 3/1987 | Ireland et al. . | |
| 4,809,459 | 3/1989 | Brylla et al. | 47/33 |
| 4,858,379 | 8/1989 | West | 47/33 |
| 4,862,668 | 9/1989 | DeGooyer | 52/747.11 |
| 4,953,341 | 9/1990 | Joos | 52/747.11 |
| 4,969,289 | 11/1990 | Trifiletti | 47/33 |
| 5,157,867 | 10/1992 | Fritch | 47/33 |
| 5,212,917 | 5/1993 | Kurtz et al. | 52/102 |

FOREIGN PATENT DOCUMENTS

| | | | |
|---|---|---|---|
| 0259735 | 3/1988 | European Pat. Off. | 404/37 |
| 3641382 | 6/1988 | Germany | 404/37 |
| 4114568 | 11/1991 | Germany . | |
| 4033937 | 4/1992 | Germany . | |
| 4133055 | 4/1992 | Germany . | |
| 332741 | 7/1930 | United Kingdom . | |
| 1230865 | 5/1971 | United Kingdom . | |

*Primary Examiner*—James A. Lisehora
*Attorney, Agent, or Firm*—Lieberman & Brandsdorfer, LLC

[57] ABSTRACT

The present invention relates to paving and systems in respect of laying pavers, and devices to aid methods of laying pavers. The apparatus of this invention is referred to as a compensating member because it compensates for spaces between adjacent pavers as well as it compensates for any expansion of the pavers once they are in situ. The compensating member (2) is fabricated so that a portion of said compensating member is compressible and most preferably is made from at least one limb which has at least one compressible formation formed thereon or as a part thereof.

28 Claims, 5 Drawing Sheets

COMPENSATING MEMBER FOR PAVERS

FIELD OF THE INVENTION

The present invention relates to paving and systems in respect of laying pavers, and devices to aid methods of laying pavers. In certain aspects, the invention relates to a compensating member for use in the laying of pavers, and to a method of laying pavers.

BACKGROUND ART

Paving is an ancient art, practised by ancient civilisations. Some examples of their work exist to this day.

The pavers of ancient is were generally made of natural materials. In modern times, pavers can be constructed from many different materials, including natural stone, and in more recent times clay pavers have become particularly important to the building industry.

Clay pavers are generally made from kiln fired clay. It is a commonly misunderstood that because the clay is fired, the clay would not continue to act as it would in the unfired state. In fact, all clay, whether fired or unfired, grows or swells, and contracts, according to moisture conditions existing in the environment. Fired clay pavers continue to grow and swell. However, they do so at a much slower rate compared with unfired clay or clay in the natural state.

Whilst this will not cause problems for the owners of the sites on which clay pavers have been laid, particularly within a few years of completion, the problem becomes evident over a longer time, because adjacent pavers rise off their base and the previously level or smooth surface becomes uneven.

Whilst layers have been aware of this problem for some time, they persist in laying clay pavers side by side, without any gap between them. This is generally a recipe for disaster, but the layers are somewhat uninterested as the difficulties occur many years after the original laying, at which time the problems fall on the shoulders of the paver manufacturers. The layers are also not interested in laying pavers with a space between them as this increases the overall time required for the task. Whilst the industry acknowledges the problem no attempts to date have been successful in providing a solution.

Paving is a difficult art, which generally requires the person paving to set a straight edge or line at regular intervals to square up the job. This adds significantly to the time required to complete large paving tasks. The additional time is exacerbated by the need to be continuously filling the voids between adjacent pavers so as to prevent any movement when they are walked on. Walking on the job is necessary sometimes in order to square up the job properly.

Another difficulty is that sand which is swept into the voids between adjacent pavers can be washed away. This will cause spacing difficulties which tend to become highly visible and detract from the appearance of the pavement.

It is an object of the invention to at least in part alleviate one or more of the problems noted above.

SUMMARY OF THE INVENTION

The invention provides a compensating member adapted to be located between adjacent laid pavers or a surface and a paver, said compensating member including a compressible construction which will accommodate expansion of said pavers, said compensating member being adapted to cooperate with said pavers so that the pavers can be laid with a predetermined spacing.

Preferably, the distance between each side surface of the compensating member is smaller than the predetermined spacing.

Preferably, the compressible region extends laterally away from a first side surface of the compensating member so that the compressible region and a second side surface of the compensating member engage respectively the sides of adjacent pavers, and so as to space same at the predetermined spacing.

Preferably the compensating member is fabricated so that a limited portion of said compensating member is compressible.

Preferably the compensating member is made from at least one limb which has at least one compressible formation formed thereon or as a part thereof.

Preferably the compensating member includes at least one limb which is corrugated.

Preferably the compensating member includes a first portion and a second portion joined together by a web or hinge portion.

Preferably the web or hinge portion allows relative rotational movement between said first and said second portions.

Preferably the compensating member includes a first portion adapted to receive a second portion.

Preferably the first and second portions are pivotally connected, such that when in a storage position, said first and second portions are positioned substantially adjacent, parallel or in-line.

Preferably the compensating member has a skeletal construction.

Preferably the compensating member is manufactured from rubber foam materials, plastics and other polymers which allow for compressibility, or are shaped to provide said compressibility.

Preferably, the compressibility is a resilient compressibility. For example, the material selected may have a memory as to its original shape which is a permanent feature of the material.

Preferably the compensating member is robust to prevent being compressed significantly during the laying process.

Preferably the compensating member is manufactured from one of or a combination of high density polythene, high density polyethylene, low density polythene, low density polyethylene or propylene.

Preferably the shape of the compensating member is that of cross or X shape, T shape or in-line shape, or can be made to conform to such a shape.

The invention also provides a compensating member adapted to be located between adjacent laid pavers or a surface and a paver, said compensating member including a generally skeletal construction and a compressible formation formed thereon said compressible formation being adapted to be comprised after said compensating member has been placed in contact with said adjacent pavers or said surface and said paver.

Preferably the compressible formation is any one of: a pitched structure; a cuneiform structure; a generally triangular structure; a circular structure; an elliptical structure; or a sinusoidal structure.

Preferably the compensating member has a two part or two portion structure, such that the movement of one portion or part relative to the other will convert said compensating member from being adapted for use in a first configuration to being adapted for use in a second configuration.

Preferably the compensating member is fabricated from a hub portion and a limb portion which have mating formulations by which they are engageable to assemble the compensating member.

Preferably one of the said formations is an undercut groove or recess.

Preferably at least two limb portions are engaged with the first portion to form one of: - a T-shaped compensating member; a cross-shaped compensating member; an in-line compensating member; in L-shaped compensating member.

Preferably the compensating member described in any of the above paragraphs includes a ground engaging anchor means.

The compensating member of the present invention can be used with any pavers or tiles such as concrete, stone, ceramic or other paver materials. If the material is not a sort to grow or swell due to moisture absorption or heat, there is still a laying advantage in using the compensating member.

An advantage which is derived from the above described features is that persons utilising these compensating members, will be able to accurately lay pavers over long distances, because the compensating member compensates for the spaces left between adjacent pavers.

The invention further provides a method of laying an array of pavers including positioning the pavers on a support bed and locating between the pavers a multiplicity of compensating members according to any one or more of the preceding paragraphs, so that the compensating members determine the spacing of the pavers but accommodate subsequent expansion of the pavers by being compressed by the pavers.

The invention still further provides a paving area including an array of pavers positioned on a support bed and a multiplicity of compensating members according to any one or more of the preceding paragraphs wherein the compensating members determine the spacing of the pavers but accommodate subsequent expansion of the pavers by being compressed by the pavers.

After the voids between adjacent tiles are filled in with sand, when the pavers expand, the compensating members will compress, thereby allowing the pavers positioning to compensate for expansion of the paver.

A further advantage stemming form the construction method includes a relatively small foot print in a storage position which reduces stock inventory volumes. The feature of a relatively movable first and second portion, or the assembly of a first portion and a second portion each provide this advantage.

A further advantage of an assembly of a first portion to a second portion is that a compensating member does not have to be broken, in order to use just one limb of the compensating member.

Another advantage which results from a skeletal construction is an optimising of the amount of material utilised to construct a compensating member.

BRIEF DESCRIPTION OF DRAWINGS

Embodiments of the present invention will now be described by way of example only with reference to the accompanying drawings in which.

DETAILED DESCRIPTION OF THE ILLUSTRATED EMBODIMENTS

Figure 1:
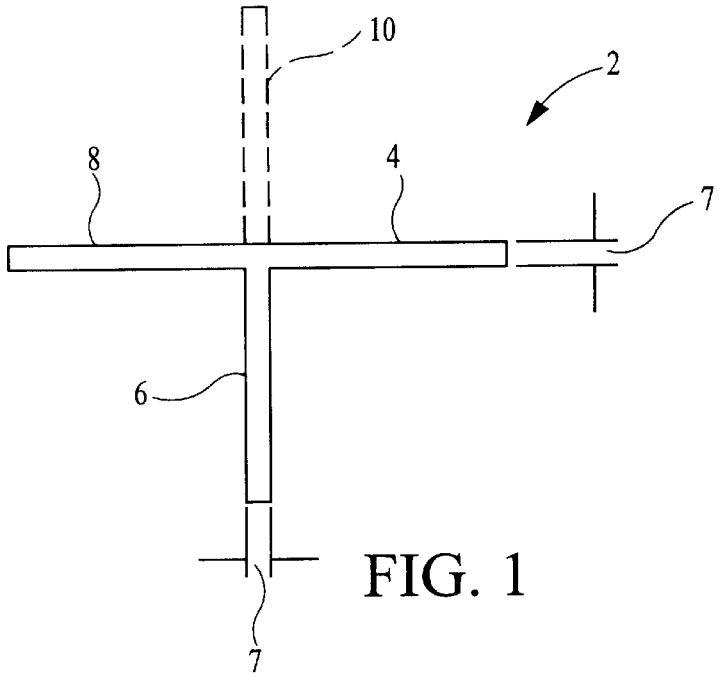
FIG. 1 illustrates a plan view of a compensating member according to a first embodiment of the present invention.

Illustrated in FIG. 1 is a compensating member 2 having arms 4, 6 and 6, 8 forming a T configuration. In phantom line is an arm 10, which would be present in an alternative X or cross configuration.

Each arm 4, 6, 8 or 10 is of the same width or thickness 7. In the example illustrated the arms are each 3 millimetres wide. It will be noted that the arms 4, 6 and 6, 8 (and 10 if it is present) are at right angles to each other. The arms 4 and 8 are at 180 degrees to each other. However, the arms 4, 6, 8 and 10 of the compensating member 2 can be manufactured at included angles other than 90 degrees, depending upon the shapes of the pavers or the patterns which are being laid.

Figure 2:
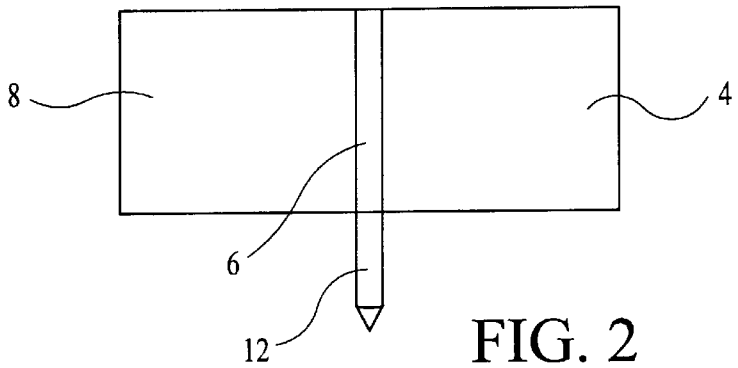
FIG. 2 illustrates a side view of the device of FIG. 1.

In FIG. 2 the compensating member 2 is approximately 25 millimetres in height and each arm 4, 6, 8 (and 10 if it is present ) is approximately 30 millimetres in length. Whilst rectangular arms 4, 6, 8 and 10 are illustrated, any appropriate shape will suffice.

The dimensions of the compensating member 2 can be varied according to need. However the heights of the arms 4, 6, 8 are in this instance 25 millimetres as they are for use with a 50 millimetres thick or high clay paver. The height of the compensating member 2 will be dependent upon the size of the paver being used. It is desirable for the compensating member to engage either a significant portion of the side face of a paver, or alternatively at a point contact. If point contact is made it may be desirable to engage the face of the paver near to the base and at another point higher up.

The chosen thickness 7 of the compensating member 2 will be dependent upon the dimensions of the paver being used and the laying requirements. The industry standard for paver spacings includes 3, 6 and 10 millimetres and thus the thickness of the compensating member 2 can be manufactured to suit. The description of this embodiment and the following embodiments will be made with reference to a spacing of 3 millimetres which is the minimum spacing recommended by paver manufacturers. It will be understood that the compensating member 2 described in this document can be dimensioned to produce any desired spacing.

In FIG. 2 it can be seen that the compensating member 2 also has a ground engaging anchor means in the form of a spike 12 which extends away from the intersection point of the arms 4, 6, and 8. The anchor spike 12 is generally round (or it can be flat), 3 millimetres in diameter, and extends some 15 millimetres away from the lower most level of the arm 4, 6, 8.

Materials which can be used to manufacture the compensating member 2 include high density polythene, high density polyethylene, low density polythene, low density polyethylene or propylene depending upon compressibility characteristics. Additional formations as described below may be required to adapt a generally incompressible material so that it can be compressed. Alternatively foam or other compressible materials can be used.

A person laying pavers utilising the compensating member 2, will first lay one paver on a support bed (which may, for example, be level ground or a prepared base, eg sand), then place compensating members 2 into position at each of the corners of be paver, with each anchor spike 12 being pushed into the paving sand or other appropriate base. This will provide the necessary spacing of 3 millimetres for each paver on the sides of the first laid paver. This process is repeated to form an array of pavers on the support bed, in which a multiplicity of compensating members are located between the paver so that the compensating members determine the spacing of the pavers but accommodate subsequent expansion of the pavers by being compressed by the pavers.

In some situations a person laying pavers can use just one arm 4 or 6 or 8 if necessary to properly space the full side of a paver, if there is insufficient room for a full compensating member 2 to be positioned. In this case the compensating member if it is manufactured from foam, can have one arm 4, 6, 8, or 10 torn off and used.

The use of the compensating member 2 will remove the need to square up the job periodically and may also remove the need to use string lines to do this squaring up during the paver laying process.

Figure 3:
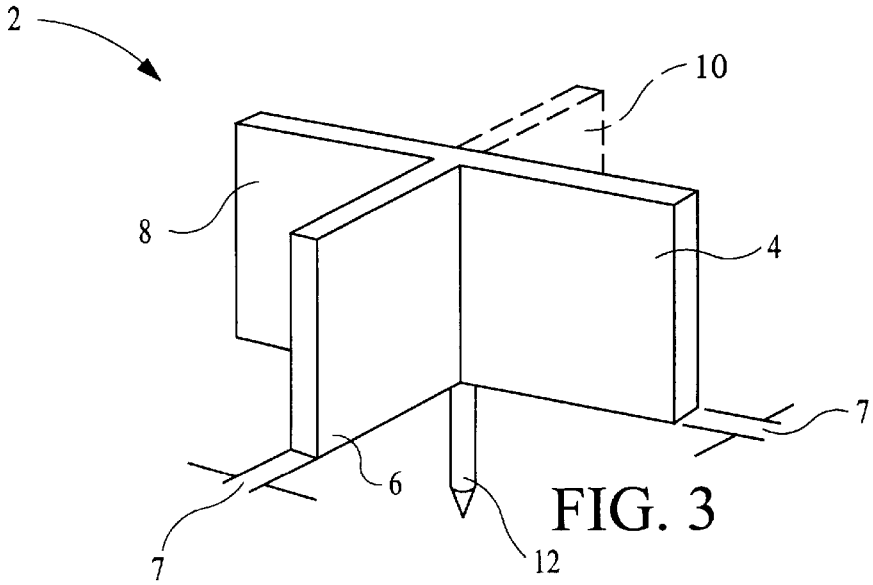
FIG. 3 illustrates a perspective view of the device of FIG. 1.

The embodiment illustrated in FIGS. 1, 2 and 3, can be modified by removing the anchor means 12, with the resulting compensating member 2 still being effective.

It is preferred that in view of the numbers of these compensating members that could be used on each laying job, the compensating members 2 are produced by injection moulding.

Figure 4:
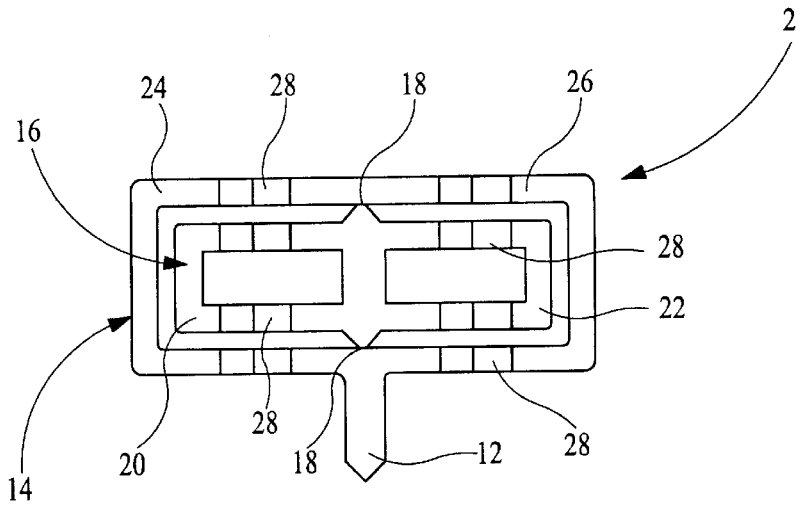
FIG. 4 illustrates a second embodiment of the present invention in front elevation.

Illustrated in FIG. 4 is another embodiment of a compensating member 2 which has a first portion 14 to which is attached a second portion 16. Portions 14, 16 are open or skeletal rectangles arranged initially with portion 16 within and coplanar with portion 14. The first or outer portion 14 has moulded with it a central anchor spike 12. The anchor spike 12 has the same function as the anchor spike 12 in FIGS. 1 to 3. The compensating member 2 of FIG. 4 differs from that of FIGS. 1 to 3 in that only a part of the compensating member 2 is compressed as will be described below.

The second portion 16 is preferably formed integrally with first portion 14 by being connected to the first portion 14 by co-axial web pivots 18, centrally located at the top and bottom. The pivots 18 are thin webs of material, that will hold the first portion 14 and second portion 16 in line or coplanar with each other until a relative rotational force is applied to the portions 14 and 16. The axis of pivots 18 is aligned with anchor spike 12. When the portion 16 is rotated relative to portion 14, the thin web of material that is each pivot 18 twists in situ, to accommodate the rotation and maintains the portions 14 and 16 connected. By rotating the first portion 14 relative to the second portion 16 the compensating member 2 will form an "X" or cross shape (FIG. 6) in which inner portion 16 defines two limbs 20, 22 and outer portion 14 defines two further limbs 24, 26.

Figure 5:
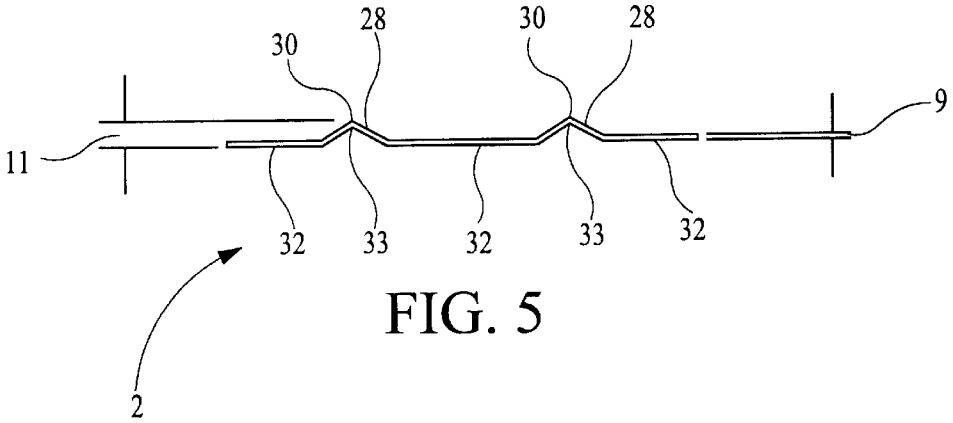
FIG. 5 is a plan view of the device of FIG. 4 and is identical to the plan view of the device of FIG. 7.

As best seen in the plan view of FIG. 5, the first portion 14 and the second portion 16 each have multiple projections or compressible formations 28 in the form of aligned offset V-shaped deformations. The apex 30 of the compressible formation 28 rests against one paver when the base surfaces 32 rest against an adjacent paver (the pavers are not illustrated). The compressible formation 28 by its construction is compressible, due to the width of the portion 14 or 16 being relatively thin. In this instance, the preferred thickness 9 is 1 millimetre whilst the overall height 11 of the compressible formation 28 is 3 millimetres, which is the minimum preferred distance between pavers. Preferably the included angle 33 subtended at the apex 30 of compressible formation 28 is 120 degrees.

Figure 7:
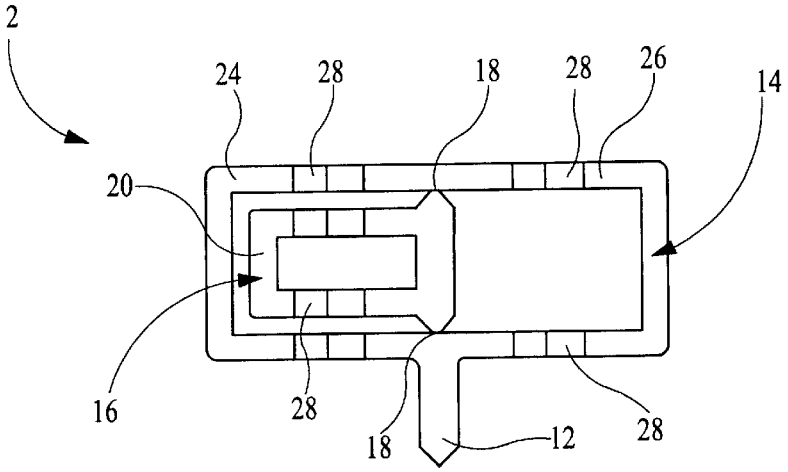
FIG. 7 illustrates a modification of the embodiment of FIG. 4.

Illustrated in FIG. 7 is a modified compensating member 2 which is similar to that of FIG. 4 except that the second portion 16 has only one limb 20. The plan view of this embodiment is identical to that as illustrated in FIG. 5 and like the embodiment of FIG. 4 the second portion 16 cannot be viewed in plan because it is hidden by the first portion 14. The respective portions 14, 16 again have compressible formations 28 to hold adjacent pavers apart.

Figure 8:
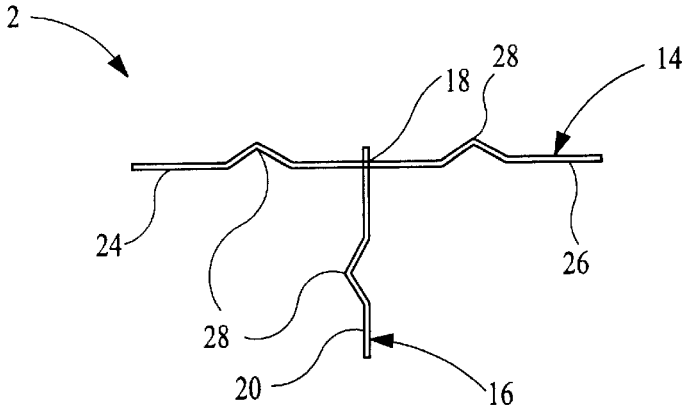
FIG. 8 is a plan view of the device of FIG. 7 when formed into a T.

Illustrated in FIG. 8 is a plan view of the embodiment of FIG. 7 after the second portion 16 has been rotated 90 degrees relative to first portion 14.

Figure 6:
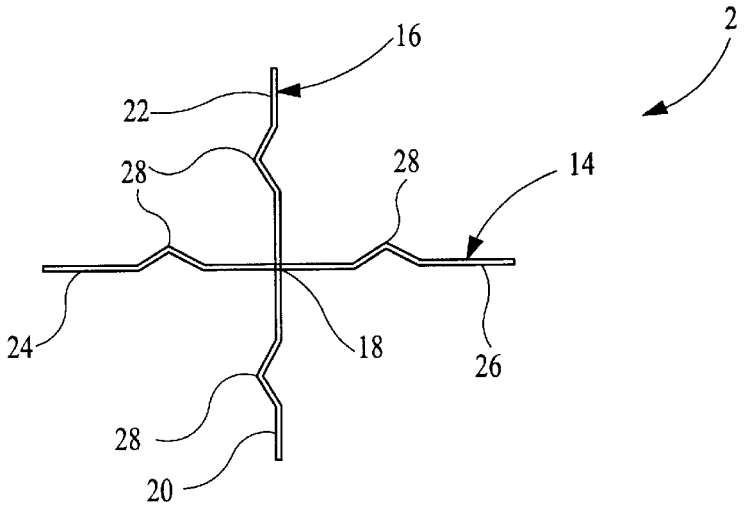
FIG. 6 is a plan view of the device of FIG. 4 when formed into a cross.

In the embodiments of FIGS. 4 to 6 and 7 and 8 because first portion 14 and second portion 16 are in line, the compensating member 2 can be used in a straight line situation. On the other hand, when the second portion 16 is rotated relative to first portion 14, either a 'X' or 'T' compensating member 2 is formed as shown in FIGS. 6 and 8 respectively. These embodiments are thus suitable for use in a variety of spacing locations.

As mentioned in respect of the embodiment of FIGS. 1, 2 and 3, it is also possible to make the compensating member 2 of FIGS. 4 to 8 without an anchor spike 12.

An alternative construction for the compensating member of FIGS. 4 to 6 is for the second portion 16 to be received within the first portion 14 by means of pivots 18 after first portion 14 is manufactured. In this construction the second portion 16 would be manufactured separately from the first portion 14, and assembled when desired. In this construction, for example, the pivots 18 may be formed integrally on second or inner portion 16 to engage depressions or recesses in the centre of the first portion 14.

Whilst the projection or compressible formation 28 is illustrated as a cuneiform, pitched or triangular shape, other shapes can be utilised such as circular, elliptical, corrugated or sinusoidal as in the embodiment of FIGS. 9 to 12. A square or rectangular compressible formation 28 can also be used but there can be some difficulties associated with these. For example once it has been compressed, there is a low likelihood of its returning to its original shape once absorbed moisture has been desorbed or after a heat expanded paver contracts on cooling. A square or rectangular compressible formation 28 may also be initially difficult to compress after it has been laid and as such is not the most preferred shape of compressible formation 28.

Figure 9:
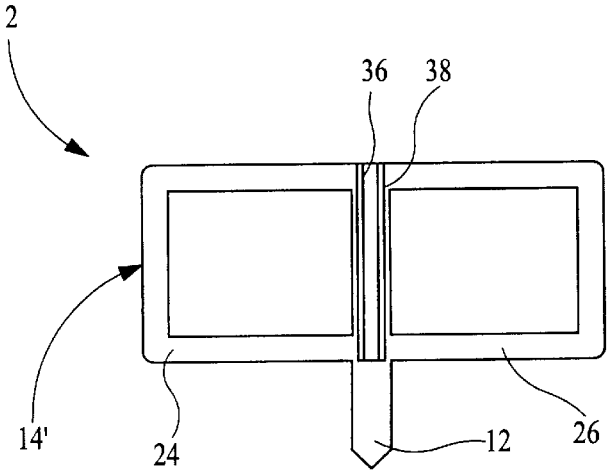
FIG. 9 is a side elevation of a first portion of the third embodiment.
Figure 10:
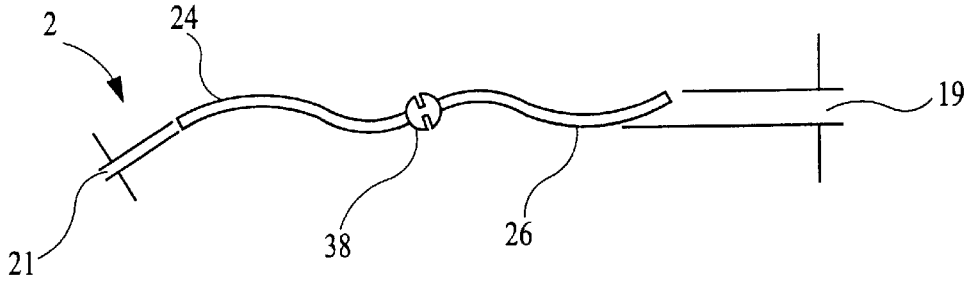
FIG. 10 illustrates the portion of FIG. 9 in plan view.
Figure 11:
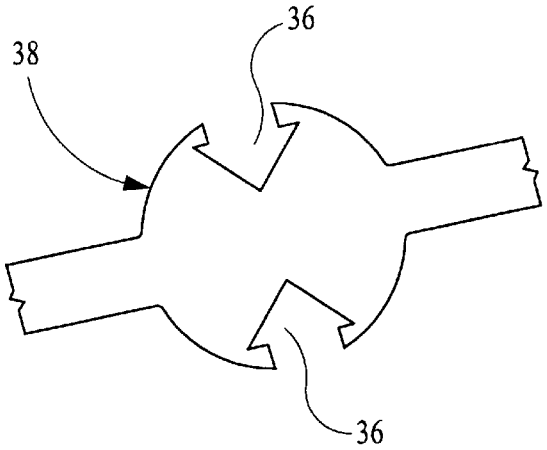
FIG. 11 is an enlarged and detailed plan view of a portion of FIG. 10.

Illustrated in FIGS. 9 to 12 are the components of a third embodiment of a compensating member 2 formed from two or three separately moulded portions 14', 16'. Portion 14' comprises an open or skeletal rectangle with a longitudinally extending central hub 38 and, aligned with the hub, an anchor spike 12. Portion 14' defines respective limbs 24,26 with respect to hub 38. Illustrated in FIG. 11 is an enlarged end view of the hub 38 alone which shows the shape of diametrally opposed undercut grooves or recesses 36 which extend along a significant portion of the hub 38 at locations displaced 90 degrees from the plane of limbs 24, 26.

Figure 12:
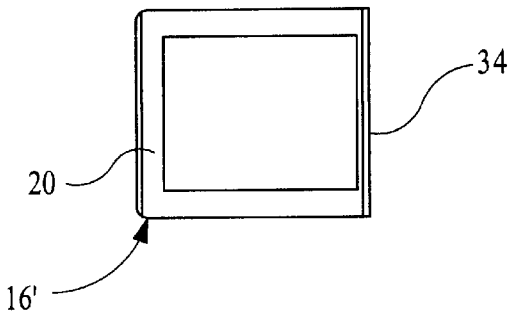
FIG. 12 is a side elevation of a second portion for assembly with the first portion of FIG. 9 to form the third embodiment of the invention.

A second portion 16' of this embodiment has one limb 20 as illustrated in FIG. 12. Each of the limbs 20, 24 and 26 is of a substantially skeletal or peripheral construction, that is the material is positioned around the periphery of the limbs 20, 24 & 26.

Portion 16' has, at one side edge, an undercut or barbed shaped flange 34. The barbed flange 34 which matches each recess 36 located on the hub 38 of first portion 14' (FIGS. 9, 10 and 11). If a cross or X-shaped compensating member 2 is required, two portions 16' each having barbed shaped flanges 34 are inserted into each of the mating recesses 36. Obviously, if a T-shaped compensating member 2 is required, only one such portion 16' is required. No additional limbs are required if a straight or in-line compensating member is required. To join a barbed shaped flange 34 into a mating recess 36, a longitudinal sliding motion is required. However, the barbs undercut engagement prevents the two from separating in directions orthogonal to the assembly direction.

In plan view, as illustrated in FIG. 10, it can be seen that the limbs 26 and 24 are of a corrugated or sinusoidal construction such that the distance 19 from a crest to trough of the corrugations is 3 millimetres. The relative thinness illustrated by dimension 21 of the limbs 24 and 26 also allows for compressibility of the limbs 24 and 26. The limb 20 of second portion 16 is constructed with corrugations in the same manner as limbs 24 and 26. The thickness of these limbs and the amplitude of the sinusoidal shape will control the compressibility characteristic of the compensating member 2.

A modification of the embodiment of FIGS. 9 to 12 is to form the hub 38 without any limbs 24 or 26. That is by replacing the limbs 24 and 26 with two further undercut recesses 36 being formed in the hub 38. In this way only as many limbs 20 of FIG. 12 need be connected to the hub 38 as required by the application, to form either an in-line; a cross-shaped; a T shaped; or an L shaped compensating member 2.

A similar arrangement can be made by combining arms or limbs which include an undercut flange 34 as in FIG. 12 but are generally straight as in portion 14 of FIG. 5 with one or more compressible formations 28, so that a variety of shapes can be made when one or more such arms or limbs are connected to a hub 38 having four undercut mating recesses 36.

Figure 13:
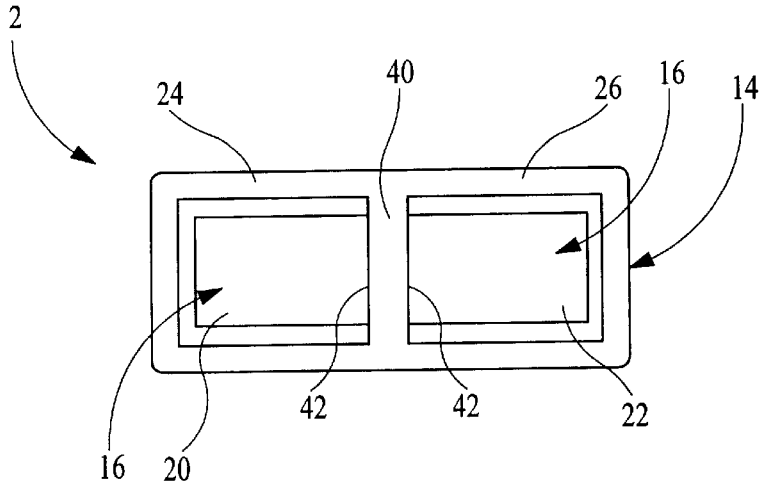
FIG. 13 illustrates in side elevation a fourth embodiment.

Illustrated in FIG. 13 is fourth embodiment of a compensating member 2 having limbs 24 and 26 on a first portion 14 and internally positioned limbs 20 and 22 on respective second portions 16. The first portion 14 and second portions 16 are constructed from a compressible material such as foam or a structure having internal transverse deformable ribs. Alternatively, a thin structure which includes compressible formations 28 can be used.

Figure 14:
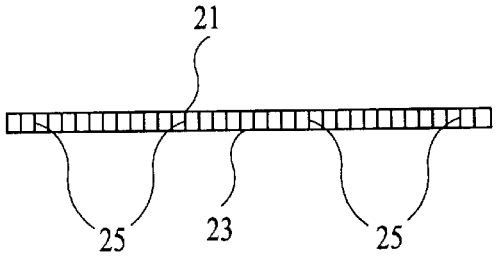
FIG. 14 is a plan view of the device of FIG. 13.

If a ribbed construction is used the plan view of this embodiment would be as illustrated in FIG. 14. A pair of flat outer sheets 21, 23 are integrally connected but spaced by a series of ribs 25. To instil in this embodiment a memory of its initially formed shape will be difficult because the sheets 21, 23 and ribs 25 are relatively thin, particularly if the thicknesses of the sheets 21, 23 and the length of the ribs 25 between the sheets total 3 millimetres or less. In larger sizes, the sheets 21, 23 and ribs 25 can each be formed with thicker dimensions giving the material a better chance to resiliently collapse, ie give effect to the memory of its original shape.

The limbs 20 and 22 are mounted by a hinging/connecting web 42 to a central hub portion 40 extending between the limbs 24 and 26 on first portion 14. (The hinging connecting web 42 acts in a similar fashion to the pivot 18 of FIG. 4). The compensating member 2 of FIG. 13 is illustrated without an anchoring spike 12, however, such an anchoring spike 12 can be added if desired. The hinging/connecting web 42 when initially formed prevents the second portion 16 from rotating out of alignment with the first portion 14. The hinging/connecting web 42 is preferably capable of withstanding a number of "in-line to 90°" oscillations and back again before breakage occurs. In some tests conducted approximately 35 such oscillations were experienced before breakage. In FIG. 13 the second portion 16 is illustrated as a solid construction, however, an open or peripheral construction similar to that of first portion 14 can also be utilised.

Figure 15:
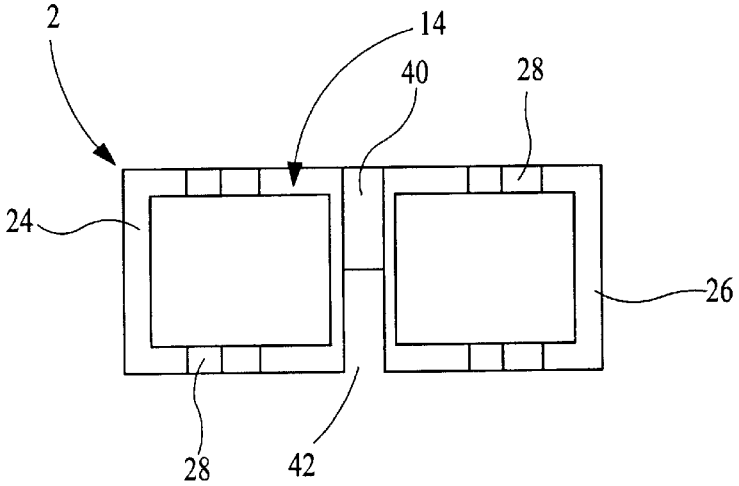
FIG. 15 illustrates in side elevation a fifth embodiment.

Illustrated in FIG. 15 is a fifth embodiment of a compensating member 2. This embodiment is made up of first portion 14 having limbs 24 and 26 which are of open or skeletal construction similar to that of other embodiments. In this embodiment compressible formations 28 are carried on the limbs 24 and 26. The limbs 24 and 26 can also be manufactured with sinusoidal limbs as in FIG. 10. The limbs may also be of a solid construction instead of a skeletal construction as illustrated. Between and linking the limbs 24 and 26 is a central hub portion 40 which extends only half the height of the limbs 24 and 26. The width of the central hub portion 40 is the same as the thickness of the portion 14, which in the preferred example is 1 millimetre. It is shown here in exaggerated size for the purpose of illustration only, as a 1 millimetre thick portion would be hardly visible. The other half of the height forms a recess 42, which is also only as wide as the thickness of the portion 14.

One compensating member 2 is combined with a like compensating member 2 to form a cross shape. This is done by inverting one of them so that the centre portion 40 mates with the recess 42 of the other portion.

The embodiments of FIGS. 4 to 15 can be manufactured from the materials listed in the description concerning FIGS. 1 to 3.

In any of the embodiments described, if a hinge is integrally formed it is preferred that the hinge can be operated by oscillating the hinged portions several times before the hinge breaks. This gives the compensating member 2 a better degree of flexibility and durability.

All embodiments can be constructed from features made up from a combination of the above described features. For example, a non peripherally constructed version can be made with a corrugated form making the device relatively thin, but compressible.

If greater or lesser compressive strength is required from the embodiments above, then for those constructed from foam, different types or grades of foam can be chosen for their particular strength or material property characteristics. For those with compressible formations 28, more compressible formations 28 can be added or the 1 millimetre thickness of the compressible formations 28 can be reduced or increased. In the case of those embodiments having a ribbed construction, more or less ribs can be added or subtracted, or their thicknesses increased or decreased.

In each of the embodiments described above, the compensating member 2 is not capable of being compressed by the forces exerted during the process of laying pavers manually.

An advantage which follows from using the compensating member 2 during a paving exercise is that the pavers maintain the correct spacing and pattern. Further, by using the compensating member 2, the job if it is not completed, can be walked on, before filling the voids with sand as the compensating members 2 keep the pavers in the correct spacing and prevent them from moving when under foot. The pavers are held by the compensating members 2 without the use of sand.

After sand has been placed in the voids between adjacent pavers, the completed job is particularly suited for use as driveways or areas where cars will pass, as the compensating members 2 are expected to be able to absorb braking and acceleration forces.

A further advantage of the compensating members 2 is that the anchor spike 12 if it is used will keep the compensating member 2 in the ground, and should the sand between adjacent pavers be washed away over time, which happens from time to time, the compensating member 2 remains in place to keep the pavers in their places. Whilst use of the compensating member 2 allows a paved area to be walked on before the gaps or voids are filled with sand, it is not intended that the compensating member 2 be a permanent substitute for filling sand or other filling material.

The foregoing describes embodiments of the present invention and modifications by those skilled in the art can be made thereto without departing from the scope of the present invention.

What is claimed is:

1. A compensating member adapted to be located between adjacently laid pavers said compensating member including a compressible region which will accommodate expansion of said pavers, said compensating member being adapted to cooperate with said pavers so that the pavers can be laid at a predetermined spacing, said compensating member having first and second side surfaces, said first and second side surfaces being spaced by a distance smaller than said predetermined spacing, said region extending laterally away from said first side surface so that said region and said second side surface engage respectively the sides of said adjacent pavers, so as to space same at said predetermined spacing.

2. A compensating member as claimed in claim 1, wherein said compensating member is made from at least one limb which has at least one compressible formation formed thereon or as a part thereof.

3. A compensating member as claimed in claim 1 wherein said compensating member includes at least one limb which is corrugated.

4. A compensating member as claimed in claim 1 wherein said compensating members includes a first portion and a second portion joined together by a web.

5. A compensating member as claimed in claim 4, wherein the web portion allows relative rotational movement between said first and said second portions.

6. A compensating member as claimed in claim 1 wherein said compensating member includes a first portion adapted to receive a second portion.

7. A compensating member as claimed in claim 1 wherein said compensating member includes a first and second portion which are pivotally connected, such that when in a storage position, said first and second portions are positioned substantially adjacent, parallel or in-line.

8. A compensating member as claimed in claim 1, wherein said compensating member has a skeletal construction.

9. A compensation member as claimed in claim 1 wherein said compensation member is manufactured from rubber foam materials, plastics or other polymers which allow for compressibility, or are shaped to provide said compressibility.

10. A compensating member as claimed in claim 1 wherein the compressibility is a resilient compressibility.

11. A compensation member as claimed in claim 1 wherein said compensating member is robust to prevent being compressed significantly during the laying process.

12. A compensating member as claimed in claim 1 wherein the compensating member is manufactured from any one of the following: high density polythene, high density polyethylene, low density polythene, low density polyethylene or propylene.

13. A compensating member as claimed in claim 1, wherein the shape of the compensating member is that of an X shape.

14. A compensating member as claimed in claim 1 wherein said member is fabricated from a hub portion and a limb portion which have mating formations by which they are engagable to assemble the compensating member.

15. A compensating member as claimed in claim 14 wherein one of said formations is an undercut groove or recess.

16. A compensating member as claimed in claim 1 wherein there is also included a ground engaging anchor means.

17. A paving area including an array of pavers positioned on a support bed and a multiplicity of compensating members according to claim 1 wherein the compensating members determine the spacing of the pavers but accommodate subsequent expansion of the pavers by being compressed by the pavers.

18. A compensating member as claimed in claim 1, wherein said compensating member includes a first portion and a second portion joined together by a hinge portion.

19. A compensation member as claimed in claim 18, wherein the hinge portion allows relative rotational movement between said first and said second portions.

20. A compensating member as claimed in claim 1, wherein said compensating member is manufactured from a polymer which allows for compressibility.

21. A compensating member as claim in claim 1, wherein said compensating member is manufactured from a polymer and is shaped to provide said compressibility.

22. A compensating member as claimed in claim 1, wherein the shape of the compensating member is that of a T shape.

23. A compensating member as claimed in claim 1, wherein the shape of the compensating member is that of an L-shape.

24. A compensating member as claimed in claim 1, wherein the shape of the compensating member is that of an in-line shape.

25. A compensating member adapted to be located between adjacently laid pavers, said compensating member including a generally skeletal construction and a compressible formation formed thereon said compressible formation being adapted to be compressed after said compensating member has been placed in contact with said paver and said surface and wherein said compensating member has a two portion structure, such that the movement of one portion relative to the other will convert said compensating member from being adapted for use in a first configuration to being adapted for use in a second configuration.

26. A compensating member as claimed in claim 25 wherein said compressible formation is one of the following: a pitched structure, a cuneiform structure; a generally triangular structure; a circular structure; an elliptical structure; a sinusoidal structure.

27. A compensating member as claimed in claim 25 wherein there is also included a ground engaging anchor means.

28. A method of laying an array of pavers including positioning the pavers on a support bed and locating between the pavers a multiplicity of compensating members, wherein each of said compensating members includes a compressible region which will accommodate expansion of said pavers, said compensating member being adapted to cooperate with said pavers so that the pavers can be laid at a predetermined spacing, said compensating member having first and second side surfaces, said first and second side surfaces being spaced by a distance smaller than said predetermined spacing; said region extending laterally away from said first side surface so that said region and said second side surface engage respectively the sides of said adjacent pavers, so as to space same at said predetermined spacing and so as to accommodate subsequent expansion of the pavers when compressed by the pavers.

* * * * *